US010986904B1

(12) United States Patent
Verret

(10) Patent No.: US 10,986,904 B1
(45) Date of Patent: Apr. 27, 2021

(54) HANDS FREE UMBRELLA APPARATUS

(71) Applicant: Preston Verret, Houma, LA (US)

(72) Inventor: Preston Verret, Houma, LA (US)

( * ) Notice: Subject to any disclaimer, the term of this patent is extended or adjusted under 35 U.S.C. 154(b) by 0 days.

(21) Appl. No.: 17/118,816

(22) Filed: Dec. 11, 2020

Related U.S. Application Data

(63) Continuation-in-part of application No. 16/720,239, filed on Dec. 19, 2019.

(51) Int. Cl.
*A45B 11/02* (2006.01)
*A45B 15/00* (2006.01)

(52) U.S. Cl.
CPC ..... *A45B 11/02* (2013.01); *A45B 15/00* (2013.01)

(58) Field of Classification Search
CPC ..... A45B 11/02; A45B 23/00; A45B 25/18
See application file for complete search history.

(56) References Cited

U.S. PATENT DOCUMENTS 225,409 A * 3/1880 Mora ..... A45B 11/02 224/190
1,041,577 A * 10/1912 Bekkevar ..... A45B 11/02 224/190
1,888,909 A * 11/1932 Crosthwait ..... A45B 11/02 224/187
2,221,366 A * 11/1940 Bisbing ..... E04H 15/28 135/16
3,151,621 A * 10/1964 Jackson ..... A45B 23/00 135/16
6,024,464 A 2/2000 De Vera
7,434,591 B2 * 10/2008 Church ..... A45B 23/00 135/16
8,042,561 B2 * 10/2011 Moravec Varga ..... A45B 25/18 135/16
8,678,019 B2 3/2014 Christie
2017/0112244 A1 * 4/2017 Viscogliosi, Jr. ..... A45B 25/18
2018/0140060 A1 * 5/2018 Ferrara ..... A45B 23/00

* cited by examiner

*Primary Examiner* — Noah Chandler Hawk
(74) *Attorney, Agent, or Firm* — Sanchelima & Associates, P.A.; Christian Sanchelima; Alexander J. Rodriguez

(57) ABSTRACT

A hands-free umbrella holder is disclosed herein. The hands-free umbrella holder includes a back covering having adjustable shoulder straps, shoulder covering, and an umbrella holding sleeve on the back covering. The umbrella holder includes a vest assembly having a shoulder portion extending substantially along a user's shoulders and towards their stomach area. The vest includes side openings providing the user ample room to move their arms. Additionally, the vest includes a back portion having a holding assembly mounted thereon. The holder assembly is a tube member that is attached to the vest through means of brackets and screws. An umbrella is then placed within the tube providing the user with shielding form the sun and other weather conditions while having full use of their hands. A shield assembly is also incorporated to provide a face mask protection against harmful viruses.

8 Claims, 7 Drawing Sheets

HANDS FREE UMBRELLA APPARATUS

OTHER RELATED APPLICATIONS

The present application is a continuation-in-part of pending U.S. patent application Ser. No. 16/720,239, filed on, Dec. 19, 2019, which is hereby incorporated by reference.

BACKGROUND OF THE INVENTION

1. Field of the Invention

The present invention relates to a hands-free umbrella apparatus and, more particularly, to a hands-free umbrella apparatus that includes a vest assembly mounted onto a user and a holding assembly configured to hold an umbrella and mounted onto the vest.

2. Description of the Related Art

Several designs for an umbrella holder have been designed in the past. None of them, however, include a hands-free umbrella holder including a back covering having adjustable shoulder straps, shoulder covering, and an umbrella holding sleeve on the back covering. The umbrella holder includes a vest assembly having a shoulder portion extending substantially along a user's shoulders and towards their stomach area. The vest includes side openings providing the user ample room to move their arms. Additionally, the vest includes a back portion having a holding assembly mounted thereon. The holder assembly is a tube member that is attached to the vest through means of brackets and screws. An umbrella is then placed within the tube providing the user with shielding form the sun and other weather conditions while having full use of their hands. It is known that during harsh weather conditions, an individual may use an umbrella to protect themselves against extreme sun, rain, and snow. It is also known, when an individual is operating a traditional umbrella to shield themselves from these conditions, they need to use one of their hands to operate the umbrella. As a result, a user has less mobility to carry their bags or operate the equipment needed in an outdoor area. Therefore, there is a need for a hands-free umbrella holder that attaches to a user's shoulders that holds the umbrella for the user. The user is able to maintain full mobility of his hands while protecting themselves from harsh weather conditions.

Additionally, due the recent Covid-19 pandemic, it is necessary that individuals often wear shield masks in order to protect themselves from being contracted with the disease. As a result, the present invention also incorporates a shield assembly which creates a face mask which is attached to the outer peripheral edge of the umbrella. The shield also includes compartments that can be used to store mobile devices, wallets, and other objects.

Applicant believes that a related reference corresponds to U.S. Pat. No. 8,678,019 issued for an umbrella engaged with a backpack. Applicant believes another related reference corresponds to U.S. Pat. No. 6,024,464 issued for an umbrella support harness. However, these references differ from the present invention because they fail to disclose a hands-free umbrella holder including a back covering having adjustable shoulder straps, shoulder covering, and an umbrella holding sleeve on the back covering. The present invention addresses these issues by providing a vest assembly configured to be attached to a user and a holder assembly attached to the vest assembly. The holder assembly holds an umbrella for a user while providing them full mobility to their hands.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide an umbrella holder that provides protection to a user from harsh weather conditions while simultaneously providing full mobility of their hands.

It is another object of this invention to provide an umbrella holder having an adjustable vest assembly that is configured to fit a variety of users. The vest assembly includes a belt strap that allows a user to properly adjust the vest to their waist.

It is still another object of the present invention to provide an umbrella holder having a holder assembly with an umbrella mounted therein. The holder assembly includes elastic straps, allowing the user to securely attach the umbrella to the holder and prevents the umbrella from being blown away due to harsh weather conditions.

It is still another object of the present invention to provide an umbrella holder having a holder assembly with an umbrella having a removable shield assembly to provide a user to a suitable face mask to protect against the spread of harmful diseases.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
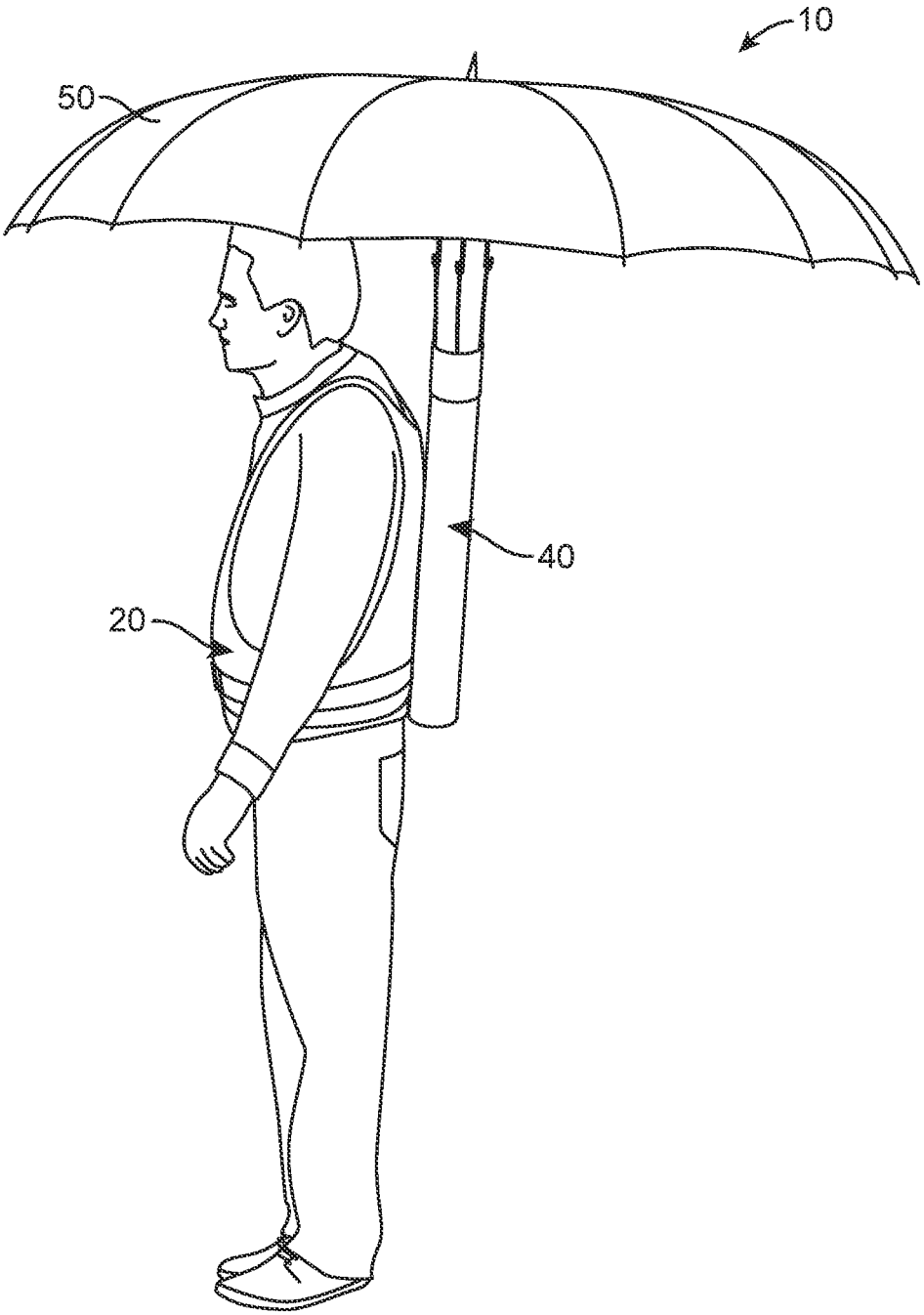
FIG. 1 represents an operational view of umbrella holder 10 in accordance to an embodiment of the present invention.
Figure 2:
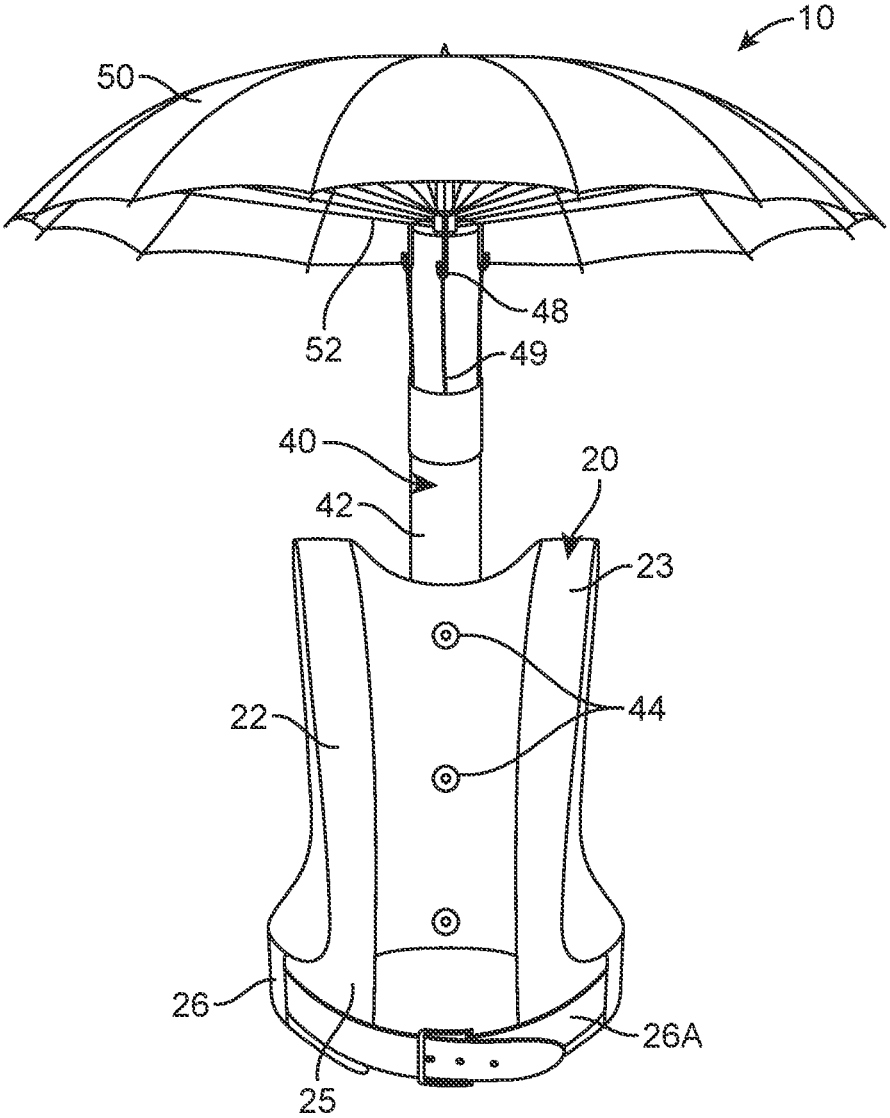
FIG. 2 shows an isometric view of umbrella holder 10 having vest assembly 20 and holder assembly 40 in accordance to an embodiment of the present invention.
Figure 3:
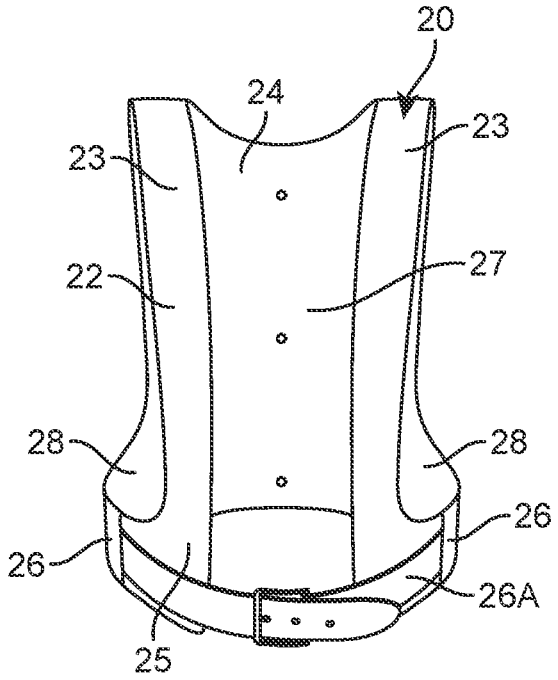
FIG. 3 illustrates an isometric view of vest assembly 20 in accordance to an embodiment of the present invention.
Figure 4:
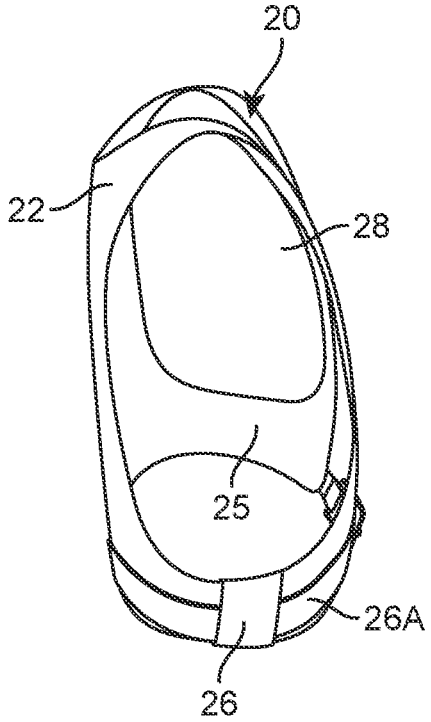
FIG. 4 is a representation of an isometric side view of vest assembly 20 in accordance to an embodiment of the present embodiment.
Figure 5:
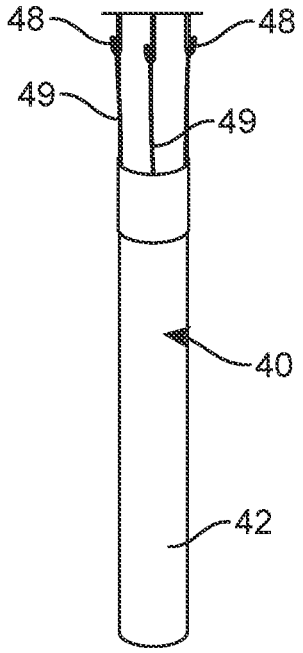
FIG. 5 shows an isometric view of holder assembly 40 in accordance to an embodiment of the present invention.
Figure 6:
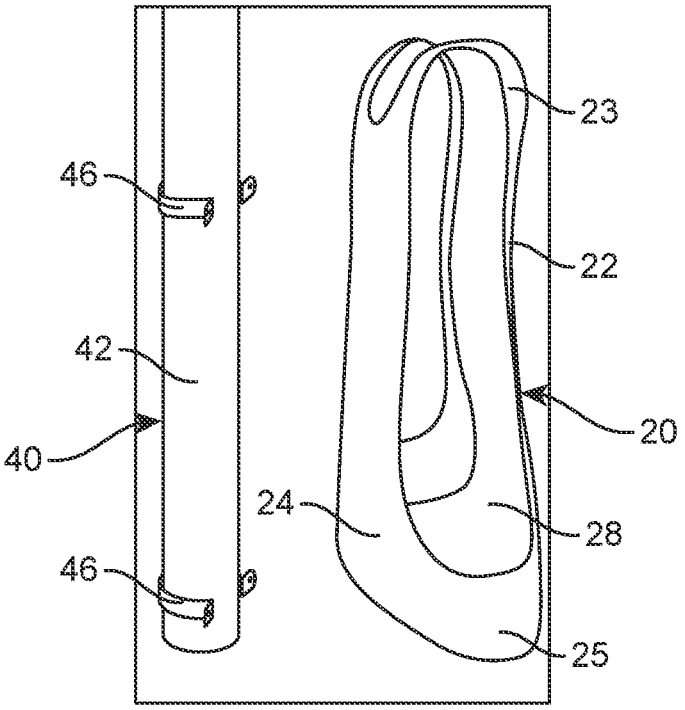
FIG. 6 illustrates a side view holder assembly 40 being attached to vest assembly 20 through mounting members 46 in accordance to an embodiment of the present invention.
Figure 7:
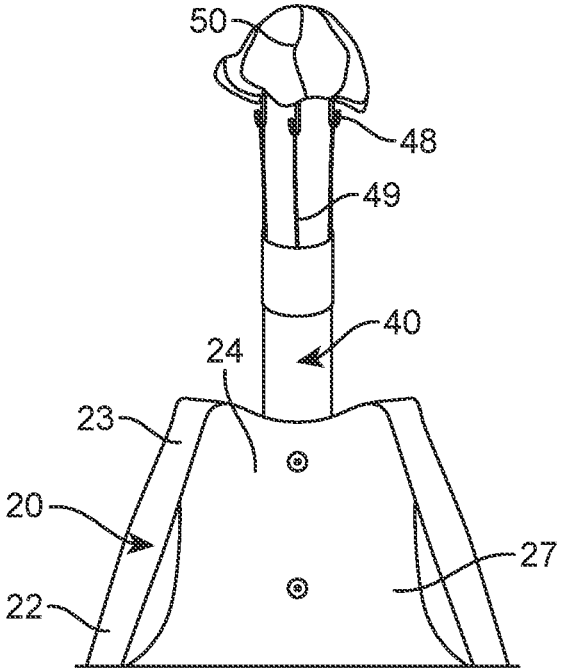
FIG. 7 represents an isometric view of umbrella holder 10 having umbrella 50 in a closed position within holder assembly 40.
Figure 8:
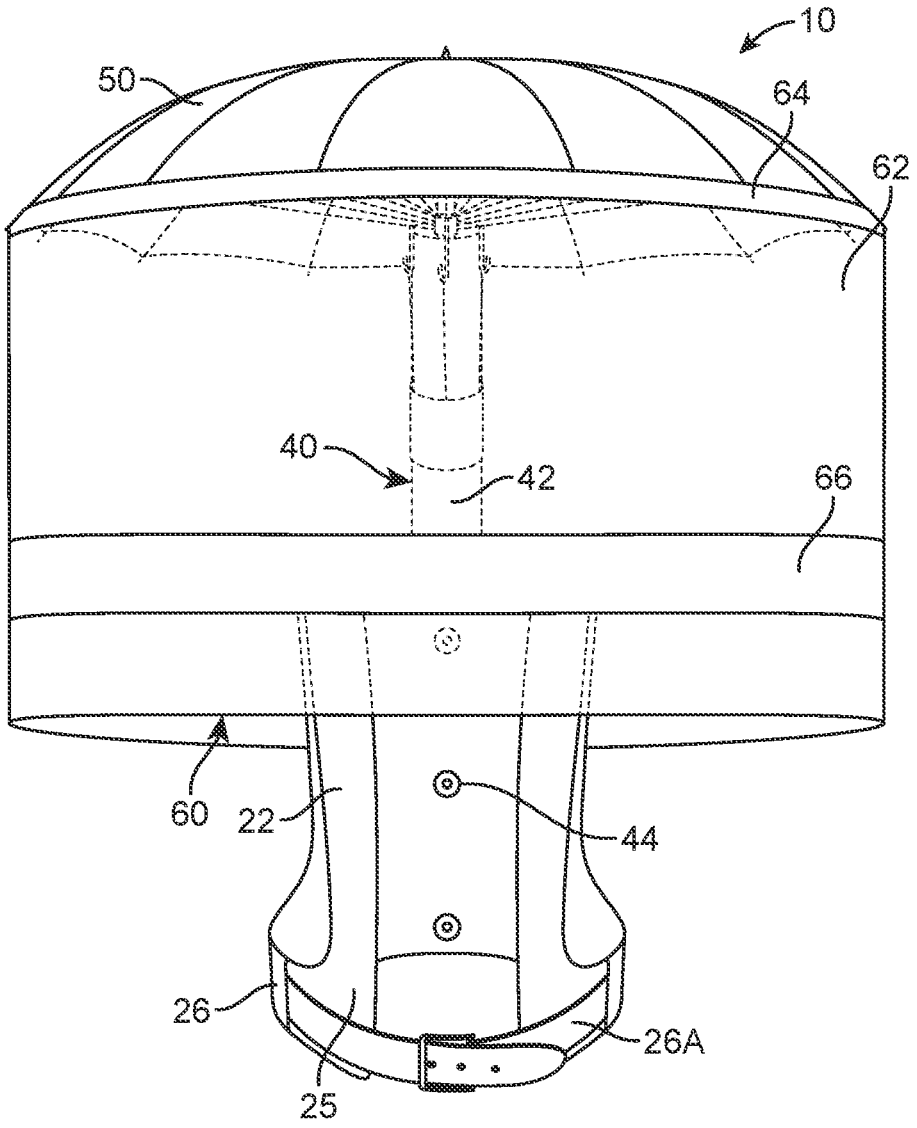
FIG. 8 shows an isometric view of shield assembly 60 mounted to the umbrella 50 in accordance to an embodiment of the present invention.
Figure 9:
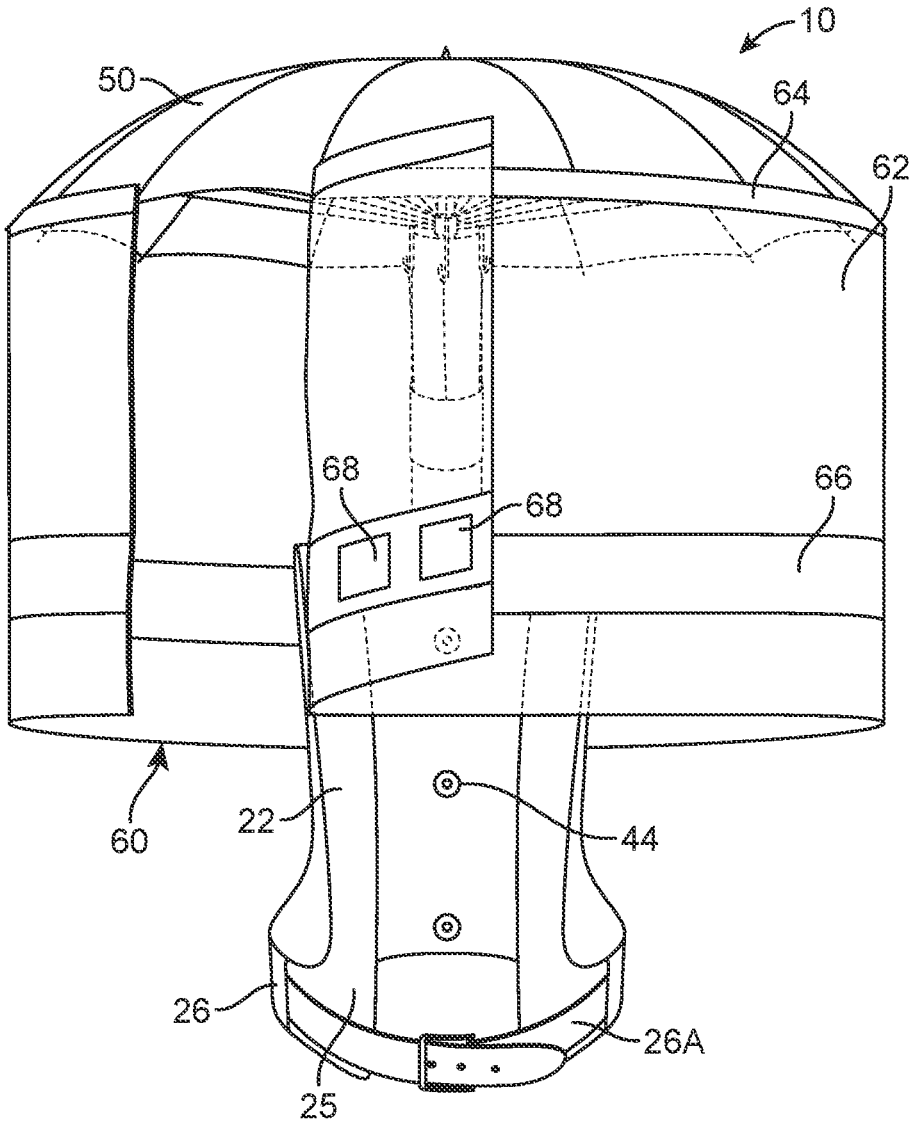
FIG. 9 illustrates another isometric view of shield assembly 60 being removed from the umbrella 50 in accordance to an embodiment of the present invention.

Referring now to the drawings, where the present invention is generally referred to with numeral 10, it can be observed an umbrella holder 10 having a vest assembly 20 and a holder assembly 40.

Vest assembly 20 includes a vest 22 having shoulder straps 23 adapted to be worn by a user. In one embodiment, vest 22 is an open vest that partially covers a user's shoulders through shoulder straps 23. Additionally, vest 22 may be made of a suitable sturdy material. This material may include materials such as but not limited to reinforced cloth, PVC frames, and the like. Additionally vest 22 further includes a back portion 24. Back portion 24 represents a back end of vest 22 that remains in contact with the user's back. Additionally, back portion 24 may have a substantially rectangular shape and entirely covers the back of a user. Shoulder straps 23 may extend from the top of each corner of back portion 24. Further, shoulder straps 23 may extend vertically along the chest of and stomach area of a user. Additionally, straps 23 may also be fairly thin straps such that they do not cover the entire front area of a user. As a result, the weight of vest 22 is lessened on the user thereby providing a lighter and more comfortable vest 22.

Vest 22 further includes a waist portion 25. In one embodiment, waist portion 25 extends from bottom sides of back portion 24 and extend along the waist of a user to then be communicably attached to shoulder straps 23. Waist portion 25 further includes slots 26 mounted thereon. In one embodiment, slots 26 is a vertically mounted rectangular member extending the entire length of waist portion 25. The rectangular member is mounted in such a way that it includes an opening thereby forming slots 26. In one embodiment, a user inserts a belt 26A through slots 26. Belt 26A then extends the entire length of back portion 24 and waist portion 25. Belt 26A may be a generic rectangular leather belt in one embodiment. Belt 26A aids the user in securing and adjusting vest 22 onto their body.

In one embodiment, vest 22 is an open vest. As a result, a center opening 27 is formed between the chest and stomach area of the user when the vest is worn. This allows vest 22 to be easily equipped by a user by inserting their body through the center opening 27 of vest 22. Center opening 27 may be a vertical opening that separates shoulder straps 23. Additionally, vest 22 includes side openings 28 located on each side of vest 22. In one embodiment, side openings 28 are oval in shape and extend up to a waist region of a user. Additionally, side openings are formed by the open area encompassing side ends of back portion 24, waist portion 25, and shoulder straps 23. Furthermore, side openings 28 are substantially large openings allowing a user to have full mobility of their arms when vest 22 is equipped.

Holder assembly 40 includes a sleeve 42. In one embodiment, sleeve 42 is a uniform hollow cylindrical tube having a top opening and a closed bottom end. Additionally, sleeve 42 receives umbrella 50 in an open configuration therein. Any type of umbrella may be used. It should be understood other shapes and embodiments of sleeve 42 may be included. Sleeve 42 is then mounted onto a center portion of back portion 24 of vest 22. In one embodiment, sleeve 42 is mounted in such a way that a bottom end of sleeve 42 remains flush with a bottom end of back portion 24. Additionally, sleeve 42 may be mounted in such a way that a top end of sleeve 42 extends beyond a top end of back portion 24. It should be understood, other mounting locations of sleeve 42 may be applicable to holder assembly 40.

In one embodiment, sleeve 42 is mounted onto back portion 24 using fastening members 44. Fastening members 44 may be generic screws as known in the art of mounting. Additionally, fastening members 44 may be positioned vertically along the center portion of pack portion 24. Fastening members 44 then communicably connect sleeve 42 to back portion 24. Sleeve 42 may also be secured to back portion 24 using mounting members 46. In one embodiment, mounting members 46 may be metal U-shaped brackets that are attached to a rear side of back portion 24 and lock sleeve 42 in place. It should be understood, any combination of fastening members 44 and mounting member 46 may be used to secure sleeve 42 to back portion 24.

Holder assembly 40 further includes loop members 48 mounted near a top end of sleeve 48. In one embodiment, loop members 48 are circular rings located near top end of sleeve 48 and integrally mounted thereon. Loop members 48 may include but are not limited to, cloth loops, metal rings, and the like. Additionally, holder assembly includes elastic cords 49 mounted thereon. Elastic cords 49 may be cords such as bungie cords or any other suitable elastic member. Furthermore, elastic cords 49 may be integrally mounted to sleeve 42 at a location beneath loop members 48. In one embodiment, elastic cords 49 are mounted in a vertical portion along the top portion of sleeve 42. Elastic cords 49 may be provided for each of loop members 48 respectively. Elastic cords 49 may be mounted parallel to each other along the top portion of sleeve 42. Further, Elastic cords 49 may be hooked onto loop members 48 to form a resting position. In one embodiment, elastic cords 49 may then be detached from loop members 48 to then be mounted onto spokes 52 of umbrella 50 in an open position. As a result, a secure attachment is created for umbrella 50 and sleeve 42. This prevents umbrella 50 from being blown away during harsh weather conditions.

In one embodiment, a user equips vest assembly 20 having holder assembly 40 mounted thereon. Umbrella 50 is then inserted within sleeve 42 in an open position. Elastic cords 49 are then removed from loop members 48 and attached to spokes 52 of umbrella 50. As a result, umbrella 50 provides protection to a user from extreme sunlight and rain. Additionally, the user maintains full use of his arms while being protected from the harsh weather conditions. In one embodiment, umbrella 50 may be stored within sleeve 42 in a closed position. In this embodiment, umbrella 50 may be entirely within sleeve 42 or partially protruding outwardly. Umbrella holder 10 provides the best protection to a user from harsh weather conditions.

Shield assembly 60 includes a shield 62 which is made of a clear material and has a cylindrical shape. Shield 62 may be provided as a rectangular sheet that is then rolled into a cylindrical configuration and mounted to umbrella 50. In the present embodiment, shield 62 has a circumference which is substantially equal to the circumference for the outer peripheral edge of the umbrella. Additionally, the clear material for the shield 62 may be a clear plastic or a clear vinyl material. In another embodiment, shield 26 may be made of a tinted material to provide protection from the sunlight. It should be understood that other suitable clear materials may be implemented for the shield 62. Shield 62 includes an outer side and an inner side. The inner side of the shield is the side that is facing towards the center of the umbrella. The outer side is the side that is facing away from the umbrella. The inner side of the umbrella includes a top periphery which comprises of hook and loop fasteners 64. In the present embodiment, the hook and loop fasteners 64 are lined along the entire periphery of the umbrella 50. It could also be appreciated that other forms of attachment members may be used in place of hook and loop fasteners 64. These attachment members may include snap buttons, zippers, adhesives and the like. In one embodiment, shield 62 has a length that extends from the edge of the umbrella up until the chest of a user. However, it should be appreciated that the length of the shield 62 may vary.

Shield assembly 60 also includes a support strip 66 as observed in the provided figures. In the present embodiment, support strip 66 extends along the entire circumference of the shield 62. Support strip 66 is a non-transparent flexible material that sits below a user's direct field of vision when mounted to the shield 62. If the support strip 66 is not lined correctly it may potentially obscure the field of vision for a user. Furthermore, support strip 66 is lined with multiple compartments 68 which may be used for storing various articles. These articles may include mobile phones, wallets, and other types of articles. In the present implementation, shield 62 serves as a face mask which provides protection against the spread of Covid-19 and other viruses. The structure also allows for a user to have a user have shield assembly 60 engaged while the user is sitting down.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for an umbrella holder, comprising:

a. a vest assembly including a vest having shoulder straps, said vest further including a back portion having a substantially rectangular shape, wherein said shoulder straps extend from each corner of a top end of said back portion, wherein said shoulder straps are adapted to extend vertically along the chest and stomach of a user, wherein said vest further includes a waist portion extending from sides of a bottom end of said back portion and configured to extend along the waist of a user, said waist portion including slots on said waist portion, said vest including a center opening and two side openings;

b. a holder assembly including a sleeve being a uniform cylindrical tube, wherein said tube receives an umbrella in an open configuration therein, wherein said sleeve is mounted to a center portion of said back portion of said vest, wherein a bottom end of said sleeve remains flush with a bottom end of said back portion, wherein said sleeve extends beyond said top end of said back portion, wherein an upper end of said sleeve includes loop members having elastic cords attached thereon, wherein said elastic cords are mounted in a vertical position along said upper end of said sleeve, wherein said elastic cords are detached from said loop members and attached to spokes of said umbrella in said open configuration; and c. a shield assembly including a shield adapted to be attached to said umbrella, wherein said shield is made of a flexible transparent material, wherein said shield includes an inner side and an outer side, wherein said inner side includes an attachment member lined on a top periphery that is received by said umbrella, wherein said shield further includes a support strip which supports a plurality of compartments which are adapted to receive articles, wherein said shield is adapted to extend from a periphery of said umbrella up to a chest area of a user.

2. The system for an umbrella holder of claim 1 wherein said attachment member is a hook and loop fastener strip.

3. The system for an umbrella holder of claim 1 wherein said shield has a cylindrical shape.

4. The system for an umbrella holder of claim 1 wherein said support strip is lined on said inner side of said shield.

5. The system for an umbrella holder of claim 1 wherein said shield extends along an entire circumference of said umbrella.

6. The system for an umbrella holder of claim 1 wherein said support strip is made of a non-transparent material.

7. The system for an umbrella holder of claim 1 wherein said flexible transparent material is tinted.

8. A system for an umbrella holder, consisting of:

a. an umbrella having spokes, b. a vest assembly, including a vest having shoulder straps, said vest further including a back portion having a substantially rectangular shape, wherein said shoulder straps extend from each corner of a top end of said back portion, wherein said shoulder straps are adapted to extend vertically along the chest and stomach of a user, wherein said vest further includes a waist portion extending from sides of a bottom end of said back portion and configured to extend along the waist of a user, said waist portion including slots on said waist portion, wherein said slots receive a belt therethrough adapted to secure said vest to a user's upper body, said vest including a center opening and two side openings;

c. a holder assembly including a sleeve being a uniform cylindrical tube, wherein said tube receives said umbrella in an open configuration therein, wherein said sleeve is mounted to a center portion of said back portion of said vest, said sleeve is mounted to said back portion through mounting members, said mounting members being metal brackets attached to a rear side of said back portion, wherein a bottom end of said sleeve remains flush with a bottom end of said back portion, wherein said sleeve extends beyond said top end of said back portion, wherein an upper end of said sleeve includes loop members having elastic cords attached thereon, wherein said elastic cords are mounted in a vertical position along said upper end of said sleeve, said elastic cords are detached from said loop members and attached to said spokes of said umbrella when said umbrella is in said open configuration; and d. a shield assembly including a shield having a cylindrical shape having an inner side and an outer side, said inner side being lined with a hook and loop fastener strip along a top periphery, wherein said shield is mounted to said umbrella through said hook and loop fastener strip, wherein said shield further includes a support strip being lined with a plurality of compartments which are adapted to hold articles, wherein said shield is adapted to extend from a periphery of said umbrella up to a chest area of a user.

* * * * *